US005178213A

United States Patent [19]

Watson et al.

[11] Patent Number: 5,178,213

[45] Date of Patent: Jan. 12, 1993

[54] AUTOMOTIVE RAM AIR SYSTEM

[75] Inventors: Richard W. Watson, West Lafayette, Ind.; Stephan G. Adelman, Greensboro, N.C.

[73] Assignee: Valeo Engine Cooling, Incorporated, Jamestown, N.Y.

[21] Appl. No.: 753,932

[22] Filed: Sep. 3, 1991

[51] Int. Cl.[5] ..... F28F 9/02

[52] U.S. Cl. ..... 165/173; 165/175

[58] Field of Search ..... 165/173, 175; 123/563; 60/599

[56] References Cited

U.S. PATENT DOCUMENTS

| | | | |
|---|---|---|---|
| 2,539,701 | 1/1951 | Przyborowski | 165/173 |
| 3,027,142 | 3/1962 | Albers et al. | 165/175 |
| 4,351,390 | 9/1982 | Argyle et al. | 165/173 |
| 4,645,002 | 2/1987 | Keyzer | 165/173 |
| 4,707,905 | 11/1987 | Clair | 165/173 |
| 4,916,902 | 4/1990 | Pratt et al. | 60/599 |

FOREIGN PATENT DOCUMENTS

| | | | |
|---|---|---|---|
| 872111 | 6/1971 | Canada | 165/173 |
| 1967053 | 11/1976 | Fed. Rep. of Germany | 165/175 |
| 1291617 | 3/1961 | France | 165/175 |

OTHER PUBLICATIONS

Agee, K. "influence of vehicle installation in the design of chassis mounted coolers" SAE Tech. Paper Series 851473 Aug. 1985.

*Primary Examiner*—John Rivell
*Assistant Examiner*—L. R. Leo
*Attorney, Agent, or Firm*—Bean, Kauffman & Spencer

[57] ABSTRACT

An improved ram air charge heat exchanger ducting system, is disclosed comprising an elongated, hollow header tank, having a generally rectangular opening therein for engagement to a header sheet of a heat exchanger core. The hollow header tank is of increasing depth from a closed end to an outlet end, and the outlet comprises an attachment ridge having a mounting surface arranged in a plane at an angle to the plane of the header mounting surface. A duct inlet has a mounting surface configured to generally mate with the mounting surface of the header outlet and, means are provided to removably attach the duct to the header outlet. This system allows variety in attachment for multiple automotive environments.

18 Claims, 3 Drawing Sheets

Fig. 9.
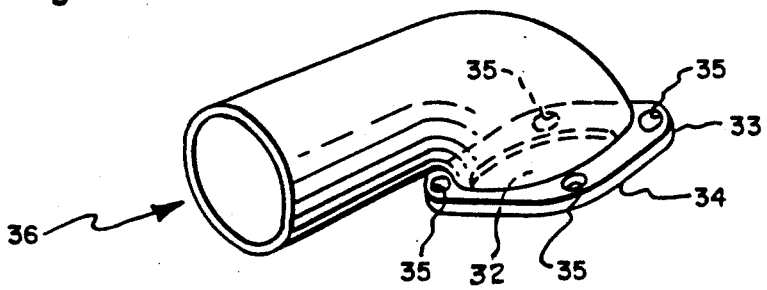
Fig. 8.
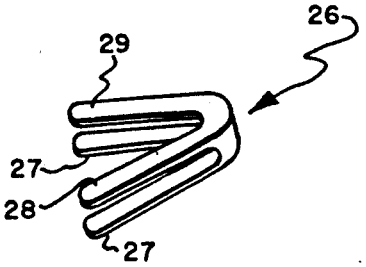
Fig. 2.
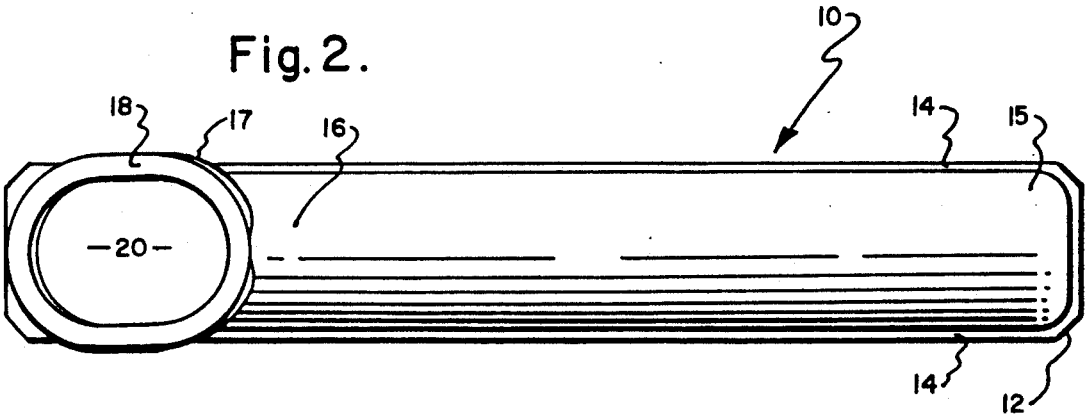
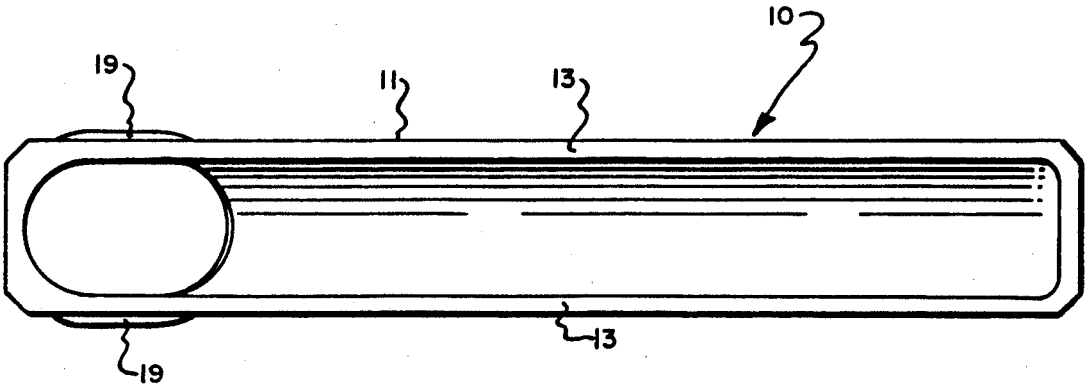
Fig. 3.

Fig. 4.
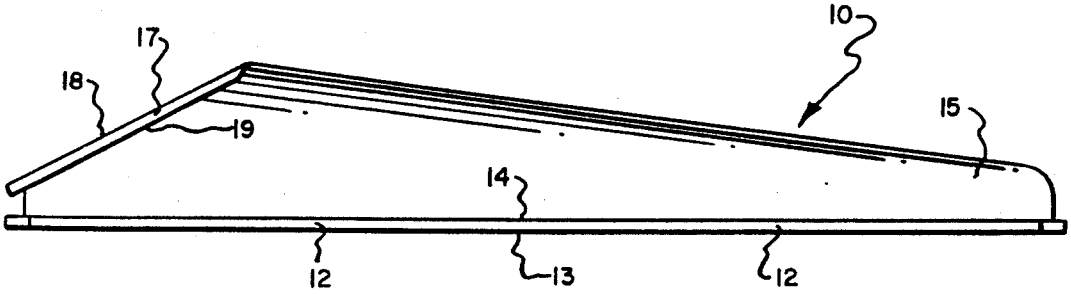
Fig. 5.
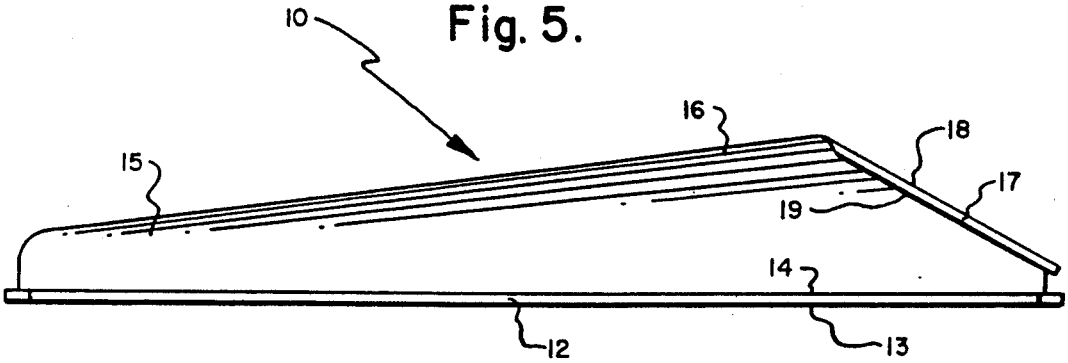
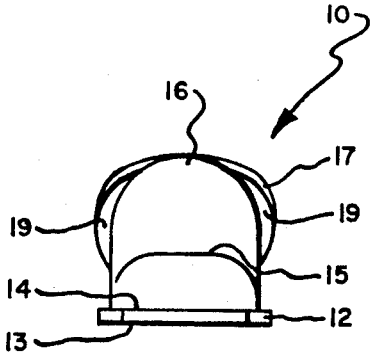
Fig. 6.
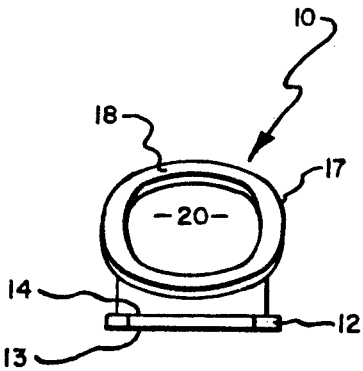
Fig. 7.

AUTOMOTIVE RAM AIR SYSTEM

This invention relates to an improved automotive ram air system, incorporating a novel header tank and interface duct, having particular application in heat exchange utilities where resistance to high internal air pressures is required.

BACKGROUND OF THE INVENTION

The widespread use of ram air charged fuel systems in the automotive industry, coupled with the continuing need to provide lighter and more efficient devices, has occasioned the development of new designs and configurations useful as heat exchanger header tanks and interface ducts for ram air charge handling in automotive systems.

In a typical ram air charged fuel system used within the automotive industry, ambient air is compressed, directed under elevated pressure through or over a heat exchanger wherein it is heated or cooled to a desirable temperature, and thereafter collected and directed to the carburetor, injection system or the like for introduction into the automotive engine.

Early ram air charged systems, still in widespread use in automotive systems, typically comprise elaborate air transmission systems in which compressed, heated air is directed to a continuous serpentine configured tube through which air can flow. The serpentine tube may have plates or fins, introduced in contact therewith to provide increased energy exchange surface areas. A cooling medium, such as ambient air, is passed over the serpentine tube and plates or fins, thus allowing energy exchange from the heated compressed air in the tube to the cooling medium. The thus cooled, compressed air is thereafter directed to the carburetor or injection system for introduction to the automotive engine.

In recent years, improved heat exchangers have been developed which comprise parallel, spaced input and output header structures interconnected by multiple parallel energy exchange tubes to allow flow of fluid, e.g. gaseous and/or liquid, between the headers. The multiple tubes are typically rounded or rectangular in configuration and have plate or convoluted fins disposed across or between the tubes to increase the heat exchange efficiency of the energy exchange tubes. The device is typically formed by inserting the multiple tubes into holes in the header structures, placing convoluted fins between the tubes, and welding or brazing the tubes to the headers.

It is an object of this invention to provide an output header tank and interface duct for use with a heat exchanger in ram air charged, energy exchange systems, having efficient ram air charged flow therethrough.

It is a further object of the invention to provide a new output header tank and ducting system for the transmission of ram charged air within an automotive environment.

These and other objects of the invention are achieved by the invention described as follows.

SUMMARY OF THE INVENTION

The invention is an improved ram air charge heat exchanger system comprising an elongated hollow output header tank, said header tank having a generally rectangular tank base comprising a generally flat header tank mounting surface and an outwardly extending header attachment ridge, for engagement to a header sheet that comprises outlets of generally parallel energy exchange structures; said hollow output header tank being of increasing depth from a first end to a second end and having a header outlet at said second end; said header outlet comprising an outwardly extending outlet attachment ridge having a header outlet mounting surface arranged in a plane at an angle to the plane of the header tank mounting surface; an interface duct, having a duct inlet comprising an outwardly extending inlet attachment ridge, said ridge having a duct inlet mounting surface configured to generally mate with said header outlet mounting surface; and, means to removably attach said duct inlet to said header outlet.

The improved ram air charge system of the invention is adaptable for use in multiple different automotive component environments and allows broad flexibility in application.

DESCRIPTION OF THE DRAWINGS

FIG. 2 is a top, plan view of the output header tank of FIG. 1.

FIG. 3 is a bottom, plan view of the output header tank of FIG. 1.

FIG. 4 is a side plan view of the output header tank of FIG. 1.

FIG. 5 is a plan view of the opposite side of the output header tank of FIG. 4.

FIG. 6 is an end view of the output header tank of FIG. 1.

FIG. 7 is a plan view of the opposite end of the output header tank of FIG. 6.

FIG. 8 is a perspective view of an attachment clip for attaching the header outlet of the header tank to an interface duct.

FIG. 9 is a perspective view of an alternate embodiment of an interface duct of the invention.

DETAILED DESCRIPTION OF THE INVENTION

Figure 1:
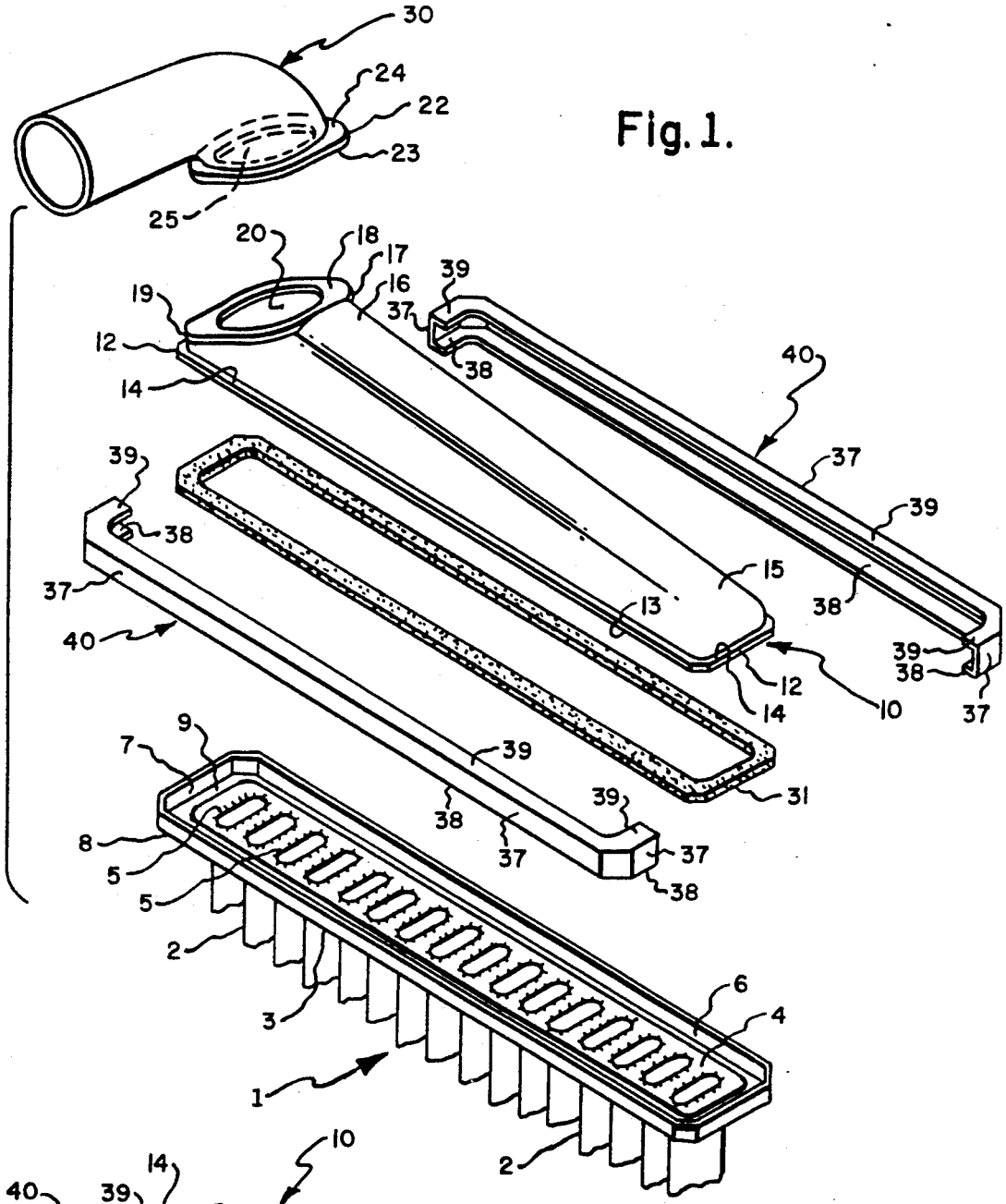
FIG. 1 is an exploded perspective view of a ram air charged heat exchanger ducting system of the present invention.

Exemplary embodiments of an automotive ram air charge heat exchanger ducting system made according to the invention are illustrated in FIGS. 1–9. It should however be understood that the present invention can be utilized in a plurality of embodiments without departing from the spirit of the invention.

Referring now to FIGS. 1–7, therein a typical automotive ram air charged heat exchanger ducting system of the invention is illustrated, comprising hollow output header tank 10 which has a generally rectangular opening in its base for engaging a generally rectangular energy exchange core header sheet to form an output header. The top and sidewalls of the tank are typically formed to provide a domed structure increasing in depth from a closed end 15 to an outlet end 16, with the outlet end comprising header outlet 20.

The tank base comprises an outwardly extending header attachment ridge 12, which in turn comprises generally flat header tank mounting surface 13 and tank strip attachment surface 14. Outlet end 16 comprises header outlet 20, which in turn comprises outwardly extending outlet attachment ridge 7, generally flat header outlet mounting surface 18 and outlet clip attachment surface 19.

Figure 1A:
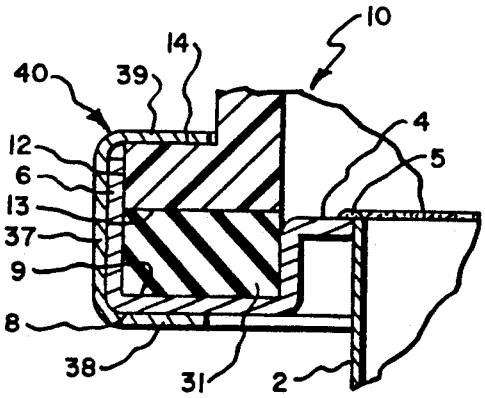
FIG 1A is a partial view, on a larger scale, of some components in the system after assembly.

Referring specifically to FIGS. 1 and 1A therein is depicted a section of a typical energy exchange core 1 as it would typically appear in exploded assembly with hollow output header tank 10. Energy exchange core 1 comprises a plurality of parallel, hollow, energy exchange structures 2 which extend from an input header (not shown) to header sheet 4 which in turn engages header tank 10 to form an output header. Disposed between said hollow energy exchange structures are convoluted fins 3 in intimate contact with said hollow energy exchange structures for energy exchange relationship. In the embodiment of FIG. 1, the plurality of energy exchange structures 2 are joined to header sheet 4 by welds 5. Header sheet 4 comprises header sheet base 8 and header sheet side walls 7. Tank attachment slot 6, is typically formed into header sheet base 8 and comprises slot mounting surface 9 with header sheet side walls 7 comprising the exterior side walls of the attachment slot.

Gasket 31 is typically included within the header assembly and engages mounting surface 9 of attachment slot 6 and mounting surface 13 of header tank 10. Outlet header tank 10 is typically assembled such that header tank mounting surface 13 engages gasket 31 in alignment with mounting slot 6. Attachment strips 40 are provided to detachably join the header tank to the header sheet to form a gasket sealed outlet header by compressingly engaging attachment surface 14 of outlet header tank 10 and header sheet base 8 to form a tight, gasketed attachment of header tank 10 to header sheet 4. The gasket preferably comprises an elastomeric material and can be generally round, oval and the like in cross-section but is preferably rectangular.

In FIGS. 1 and 1A attachment strip 40 comprises attachment strip base 37 and attachment legs 38 and 39. In attachment of the header tank to the header sheet attachment leg 38 engages header sheet base 8 along a lengthwise dimension of the header sheet and at each end partially along the widthwise dimensions. Attachment leg 39 engages strip attachment surface 14 of header tank 10, in the same manner. Using two opposing attachment strips provides strip engagement of the header tank around the periphery of the header sheet with the strips meeting at about the middle of the widthwise dimension. Strip base 37 typically holds the attachment legs (toward) parallel which in turn compressingly engage the header tank to the header sheet. It should be understood that the legs of the attachment strip may be crimped to or otherwise closed toward each other to maintain compressing engagement of the header sheet and tank.

FIG. 1 also depicts the attachment of interface duct 30 to header outlet 20 of header tank 10. Therein, interface duct 30 comprises a duct inlet 25, having an outwardly extending duct attachment ridge 22 which in turn comprises mounting surface 23 and attachment surface 24. The duct attachment ridge is typically configured to generally mate with outlet attachment ridge 17 of header tank 20 for sealed engagement of mounting surface 23 with header outlet mounting surface 18. Though not illustrated in the figures, a gasket is typically included between mounting surfaces 23 and 18.

FIG. 8 comprises a typical attachment clip useful in removably attaching interface duct inlet 25 to header outlet 20 of header tank 10. Therein, attachment clip 26 comprises attachment clip base 27 and spring legs 28 and 29. In such embodiment, clip base 27 engages outlet attachment surface 19 of header outlet 20 and spring legs 28/29 engage attachment surface 24 of interface duct 30 to compressingly engage the interface duct inlet to the header outlet.

FIG. 9 comprises an alternate embodiment of an interface duct. Therein, interface duct 36 comprises duct inlet 32, having outwardly extending attachment ridge 33, with mounting surface 34 and having holes 35 therein generally mating with holes, polymeric heat stakes, rivets, bolts or the like, in the outlet attachment ridge 17 of a header tank for attachment of the header tank outlet to the duct inlet. Generally a gasket or the like is provided between mounting surface 34 of the duct inlet and the mounting surface of the header outlet.

In a typical operation of the illustrated embodiment compressed air flows through the passages of the plurality of hollow energy exchange structures, heat energy is transferred to or from fluid passing over the energy exchange structures and the convoluted fins in contact therewith. The so treated compressed air passes to the header tank where it is directed to the outlet by the increasing depth to the duct to the carburetor, injector system or the like of the engine for use.

Generally, many of the components of the system are desirably formed from aluminum, copper or polymeric materials. For example, the hollow header tank and interface duct is typically manufactured from a rigid or semi-rigid, heat resistant polymeric or aluminum material. The header sheet and energy exchange structures of the energy exchange core are typically formed from copper or preferably aluminum. The gaskets are typically formed from elastomers, but may be formed from any suitable gasket material, including the malleable metals. Generally, the materials must be capable of withstanding pressures up to about 100 psi and temperatures up to about 500° F. The system itself typically must be capable of handling like temperatures and pressures but generally it is operated at pressures up to about 50 psi, while operating temperatures at the output header and interface duct are generally about 250° to about 350° F. Ducting is typically manufactured from a flexible polymeric material. The header outlet mounting surface is arranged in a plane at an angle to the plane of the header tank mounting surface, preferably wherein the angle is from about 15 to about 90 degrees.

It should be understood that though the illustrated invention comprises an automotive ram air charge system, the invention is seen as being applicable to multiple heat exchanger utilities.

We claim:

1. An improved ram air charge heat exchanger system, comprising an elongated, hollow output header tank, said header tank having a base with a generally rectangular opening therein and comprising a generally flat header mounting surface and an outwardly extending attachment ridge for engagement to a header sheet of an energy exchange core; said hollow output header tank formed to provide a hemispherical domed structure and being of increasing depth from a first end to a second end and having a header outlet at said second end, disposed within the direction of and at an oblique angle to the fluid flow from the first end to the second end; said header outlet comprising an outwardly extending outlet attachment ridge and having a header outlet mounting surface; an interface duct, having an inlet comprising an outwardly extending attachment ridge, said ridge having a duct inlet mounting surface configured to generally mate with said header outlet mounting surface; and, means to removably attach said duct inlet to said header outlet.

2. The system of claim 1 comprising means for detachably engaging said header tank mounting surface to said header sheet.

3. The system of claim 2 wherein said means for detachably engaging comprises an attachment strip means.

4. The system of claim 3 wherein said attachment strip is crimped to engage said attachment ridge of said header tank.

5. The system of claim 3 wherein said attachment strip means compressingly engages said header attachment ridge to said header sheet.

6. The system of claim 1 wherein said header outlet mounting surface is arranged in a plane at an angle to the plane of the header tank mounting surface.

7. The system of claim 5 wherein said angle is from about 15 to about 90 degrees.

8. The system of claim 1 wherein said energy exchange core comprises energy dissipating fins extending between energy exchange structures.

9. The system of claim 1 comprising gasket means between said header tank mounting surface and said header sheet.

10. The system of claim 1 comprising gasket means between said header outlet mounting surface and said duct inlet mounting surface.

11. The system of claim 1 wherein said header sheet comprises a tank attachment slot.

12. The system of claim 1 comprising clip means for compressingly engaging said duct inlet attachment ridge to said header outlet mounting surface.

13. The system of claim 1 comprising a polymeric header tank and an aluminum header sheet.

14. The system of claim 1 comprising an aluminum header tank and an aluminum header sheet.

15. The system of claim 1 comprising a copper energy exchange core.

16. The system of claim 1 comprising a copper header tank.

17. An improved automotive heat exchanger header tank having a base comprising an elongated, generally rectangular, opening therein, said base comprising a generally flat tank mounting surface and an outwardly extending header attachment ridge; said tank, formed to provide a hemispherical domed structure, being hollow and of increasing depth from a first end to a second end and having an outlet at said second end, disposed within the direction of and at an oblique angle to the fluid flow from the first end to the second end; said outlet comprising an outwardly extending attachment ridge having a mounting surface arranged in a plane at an angle to the plane of the tank mounting surface.

18. The tank of claim 17 wherein said angle is from about 15 to about 90 degrees.

* * * * *